US010353342B2

(12) United States Patent
Nishikawa et al.

(10) Patent No.: US 10,353,342 B2
(45) Date of Patent: Jul. 16, 2019

(54) MEDIUM COOLING APPARATUS AND MEDIUM COOLING MEMBER

(71) Applicant: FUJI XEROX CO., LTD., Tokyo (JP)

(72) Inventors: Satoru Nishikawa, Yokohama (JP); Teruki Kishimoto, Ebina (JP); Takashi Saeki, Ebina (JP); Keijiro Hamaba, Ebina (JP); Shinji Kawashima, Ebina (JP); Yasunori Momomura, Yokohama (JP); Shinya Mitorida, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/004,438

(22) Filed: Jun. 11, 2018

(65) Prior Publication Data

US 2019/0086861 A1 Mar. 21, 2019

(30) Foreign Application Priority Data

Sep. 21, 2017 (JP) ..... 2017-181516
Sep. 25, 2017 (JP) ..... 2017-183650
Oct. 30, 2017 (JP) ..... 2017-208869

(51) Int. Cl.
*G03G 21/20* (2006.01)
*G03G 15/00* (2006.01)

(52) U.S. Cl.
CPC ..... *G03G 21/206* (2013.01); *G03G 15/6529* (2013.01)

(58) Field of Classification Search
CPC ..... G03G 21/206; G03G 15/6529
See application file for complete search history.

(56) References Cited

U.S. PATENT DOCUMENTS 5,089,857 A * 2/1992 Xydias ..... G03G 15/2064 271/186
6,094,560 A * 7/2000 Thomas ..... G03G 15/6576 162/271
6,259,871 B1 * 7/2001 Rider ..... B65H 29/00 399/405
6,904,260 B2 * 6/2005 Behnke ..... B41J 11/0015 399/341

(Continued)

FOREIGN PATENT DOCUMENTS

JP 2011227315 11/2011
JP 2012008346 1/2012
JP 2012226102 11/2012

OTHER PUBLICATIONS

Kobundo Co., Ltd., "KBD XEIKON", online catalogue, with English explanation, available at http:/www.kobundo.co.jp/catalogue/pdf/kbd__Xeikon_cat.pdf ,P5, retrieved on Jun. 1, 2015.

*Primary Examiner* — G. M. A Hyder
(74) *Attorney, Agent, or Firm* — JCIPRNET

(57) ABSTRACT

There is provided a medium cooling apparatus. A first cooling unit cools a medium by absorbing heat from the medium when the medium is in contact with an outer surface of the first cooling unit. A second cooling unit is arranged on the downstream side from the first cooling unit in a medium conveyance direction, and cools the medium by absorbing heat from the medium when the medium is in contact with an outer surface of the second cooling unit, and is set such that an amount of heat absorption is smaller than an amount of heat absorption of the first cooling unit.

18 Claims, 9 Drawing Sheets

(56) References Cited

U.S. PATENT DOCUMENTS 7,616,921 B2 * 11/2009 Shida ..... G03G 15/6573 271/202
7,865,122 B2 * 1/2011 Koyama ..... G03G 15/6573 399/341
2002/0134882 A1 * 9/2002 Lind ..... B65H 23/24 242/615.12
2002/0172524 A1 * 11/2002 Anderson ..... B65H 29/00 399/92
2010/0201061 A1 * 8/2010 Zirilli ..... B41F 33/0036 271/225
2011/0135363 A1 * 6/2011 Funayanagi ..... B65H 29/242 399/397
2011/0318078 A1 12/2011 Aoi
2012/0268751 A1 10/2012 Ishida
2014/0186081 A1 * 7/2014 Hirasawa ..... G03G 15/6573 399/341
2014/0308058 A1 * 10/2014 Ikeda ..... G03G 15/6573 399/341
2014/0327207 A1 * 11/2014 Nakagaki ..... B65H 7/20 271/262
2015/0075207 A1 * 3/2015 Karikusa ..... B65H 29/12 62/380
2015/0160610 A1 * 6/2015 Watanabe ..... G03G 21/206 271/272
2015/0220030 A1 * 8/2015 Watanabe ..... G03G 15/2028 399/341
2016/0137442 A1 * 5/2016 Rietbergen ..... B65H 29/56 271/276
2017/0259466 A1 * 9/2017 Domeniconi ..... B29C 35/041
2018/0065825 A1 * 3/2018 Albers ..... B65H 85/00

* cited by examiner

MEDIUM COOLING APPARATUS AND MEDIUM COOLING MEMBER

CROSS-REFERENCE TO RELATED APPLICATIONS

This application is based on and claims priority under 35 USC 119 from Japanese Patent Applications No. 2017-181516 filed on Sep. 21, 2017, No. 2017-183650 filed on Sep. 25, 2017, and No. 2017-208869 filed on Oct. 30, 2017.

BACKGROUND

Technical Field

The present invention relates to a medium cooling apparatus and a medium cooling member.

SUMMARY

According to an aspect of the invention, there is provided a medium cooling apparatus including: a first cooling unit that cools a medium by absorbing heat from the medium when the medium is in contact with an outer surface of the first cooling unit; and a second cooling unit that is arranged on the downstream side from the first cooling unit in a medium conveyance direction, and cools the medium by absorbing heat from the medium when the medium is in contact with an outer surface of the second cooling unit, and is set such that an amount of heat absorption is smaller than an amount of heat absorption of the first cooling unit.

BRIEF DESCRIPTION OF THE DRAWINGS

Exemplary embodiments of the present invention will be described in detail based on the following figures, wherein.

DETAILED DESCRIPTION

Figure 1:
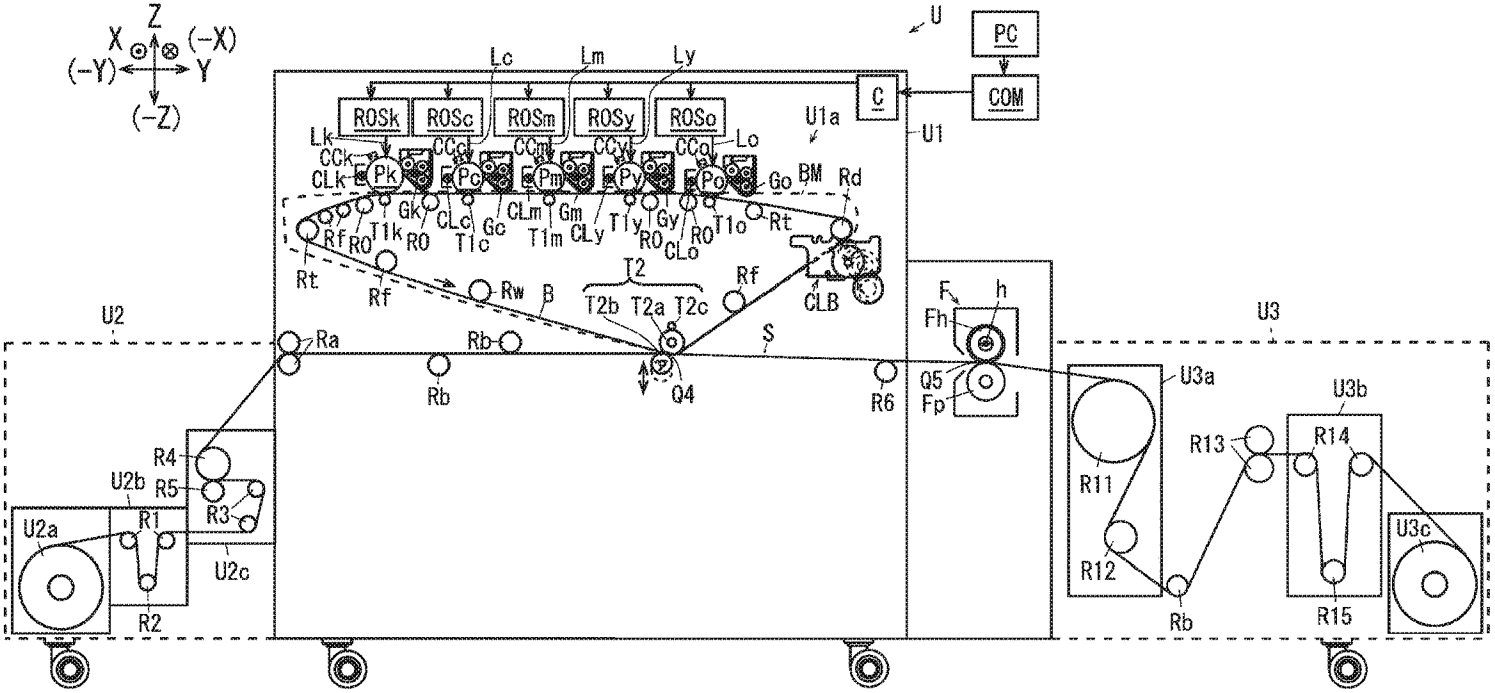
FIG. 1 is a view for explaining the whole of an image forming apparatus of first to third examples.

Hereinafter, as specific examples of an embodiment of the present invention, examples will be described with reference to the accompanying drawings; however, the present invention is not limited to the following examples.

Also, in order to facilitate understanding of the following description, in the drawings, a front-rear direction, a left-right direction, and an up-down direction are referred to as an X-axis direction, a Y-axis direction, and a Z-axis direction, respectively, and directions or sides indicated with arrows X, −X, Y, −Y, Z, and Z are represent the frontward direction, the rearward direction, the rightward direction, the leftward direction, the upward direction, and the downward direction, or as the front side, the rear side, the right side, the left side, the upper side, and the lower side, respectively.

Further, in the drawings, a mark "⊙" means an arrow indicating a direction from the rear of each drawing sheet toward the front, and a mark "⊗" means an arrow indicating a direction from the front of each drawing sheet toward the rear.

However, in the following description using the drawings, in order to facilitate understanding, components other than members necessary to explain are properly omitted in the drawings.

FIRST EXAMPLE

Description of Overall Configuration of Printer U of First Example

FIG. 1 is a view for explaining the whole of an image forming apparatus of a first example.

In FIG. 1, a printer U is shown as an example of the image forming apparatus of the first example of the present invention, and includes a main printer body U1, a feeder unit U2 which is an example of a feeding apparatus for feeding media into the main printer body U1, and a withdrawing unit U3 which is an example of a withdrawing apparatus for withdrawing media having images recorded thereon.

Description of Marking Configuration of First Example

In FIG. 1, the main printer body U1 includes a control unit C for performing control on the printer U, a communication unit (not shown in the drawing) for receiving image information from a print image server COM which is an example of an external information transmission apparatus connected to the printer U via a dedicated cable (not shown in the drawing), and a marking unit U1*a* which is an example of an image recording unit for recording images on media, and so on. The print image server COM is connected to a personal computer PC which is an example of an image transmission apparatus for transmitting information on images to be printed by the printer U, via a wired or wireless communication line.

The marking unit U1*a* includes photosensitive members Py, Pm, Pc, and Pk for individual colors, i.e. yellow (Y), magenta (M), cyan (C), and black (K) which are examples of image carriers, and a photosensitive member Po for forming images with glossy toner for giving a gloss to images, for example, in the case of printing photo images and the like.

In FIG. 1, in the vicinity of the photosensitive member Pk for black, a charger CCk, an exposing unit ROSk which is an example of a latent-image forming unit, a developing unit Gk, a primary transfer roller T1*k* which is an example of a primary transfer member, and a photosensitive-member cleaner CLk which is an example of a cleaner for an image carrier are arranged along the rotation direction of the photosensitive member Pk.

Also, in the vicinities of the other photosensitive members Py, Pm, Pc, and Po, similarly, chargers CCy, CCm, CCc, and CCo, exposing units ROSy, ROSm, ROSc, and ROSo, developing units Gy, Gm, Gc, and Go, primary transfer rollers T1*y*, T1*m*, T1*c*, and T1*o*, and photosensitive-member cleaners CLy, CLm, CLc, and CLo are arranged.

In the upper part of the marking unit U1*a*, as examples of containers, toner cartridges (not shown in the drawing) containing developers to be fed to the developing units Gy to Go are supported so as to be removable.

Below the photosensitive members Py to Po, an intermediate transfer belt B which is an example of an intermediate transfer member and is also an example of an image carrier is arranged, such that the intermediate transfer belt B is interposed between the photosensitive members Py to Po and the primary transfer rollers T1*y* to T1*o*. The rear surface of the intermediate transfer belt B is supported by a drive roller Rd which is an example of a drive member, tension rollers Rt which are tensioning members, a walking roller Rw which is an example of a meandering prevention member, an idler rollers Rf which are examples of driven members, a backup roller T2*a* which is an example of a counter member for secondary transfer, retraction rollers R0 which are examples of movable members, and the primary transfer rollers T1*y* to T1*o*.

On a part of the front surface of the intermediate transfer belt B around the drive roller Rd, a belt cleaner CLB which is an example of a cleaner for the intermediate transfer member is arranged.

On the opposite side of the intermediate transfer belt B to the backup roller T2*a*, a secondary transfer roller T2*b* which is an example of a counter member and is also an example of a transfer member and is also an example of a secondary transfer member is arranged so as to face the backup roller. Further, the secondary transfer roller T2*b* of the first example is configured to be contact with a position on the intermediate transfer belt B on the upstream side in the rotation direction of the intermediate transfer belt from the lower end of the intermediate transfer belt B which is the center of a part wound around the backup roller T2*a*. Also, the secondary transfer roller T2*b* of the first example is pushed against the backup roller T2*a* by a spring (not shown in the drawing) which is an example of a pushing member.

Also, the backup roller T2*a* is in contact with a contact roller T2*c* which is an example of a contact member for applying a voltage to the backup roller T2*a*, wherein the voltage has the opposite polarity to the polarity which the developers are charged with.

The backup roller T2*a*, the secondary transfer roller T2*b*, and the contact roller T2*c* constitute a secondary transfer unit T2 of the first example which is an example of a transfer unit, and the primary transfer rollers T1*y* to T1*o*, the intermediate transfer belt B, the secondary transfer unit T2, and so on constitute a transfer unit (T1, B, T2) of the first example.

In the feeder unit U2, a paper feeding member U2*a* having a continuous paper sheet S wound thereon like a roll is supported so as to be rotatable. The continuous paper sheet is an example of a continuous medium. The continuous paper sheet S spread out from the paper feeding member U2*a* is sent into a first tension adjustment mechanism U2*b*. The first tension adjustment mechanism U2*b* includes a pair of guide rollers R1 which are examples of guide members. The guide rollers R1 are arranged along the conveyance direction of the continuous paper sheet S. Between the guide rollers R1, a dancer roller R2 which is an example of a tensioning member is arranged. The dancer roller R2 is supported so as to be raisable and lowerable in a state where it is in contact with the front surface of the continuous paper sheet S. Therefore, the dancer roller R2 tensions the continuous paper sheet S with the weight of the dancer roller R2. Further, rotation of the paper feeding member U2*a* of the first example is controlled such that the paper feeding member sends out the continuous paper sheet S if the height of the dancer roller R2 is higher than a preset delivery height and stops sending out the continuous paper sheet S if the height of the dancer roller R2 becomes lower than a preset stop height.

On the downstream side from the first tension adjustment mechanism U2*b* in the conveyance direction of the continuous paper sheet S, a paper feeding mechanism U2*c* which is an example of a unit for conveying a continuous paper sheet S is arranged. The paper feeding mechanism U2*c* has guide rollers R3 which are examples of guide members. On the downstream side from the guide rollers R3, a paper feeding roller R4 which is an example of a first conveying member and is also an example of a drive member and is also an example of a paper feeding member is arranged. On the opposite side of the continuous paper sheet S to the paper feeding roller R4, a nipping roller R5 which is a counter member is arranged. The paper feeding roller R4 feeds the continuous paper sheet S at a conveyance speed preset for the continuous paper sheet S. The nipping roller R5 nips the continuous paper sheet S together with the paper feeding roller R4 with a preset pressure in order to suppress the paper feeding roller R4 and the continuous paper sheet S from slipping on each other. Also, the guide rollers R3 guide the continuous paper sheet S such that the contact area of the paper feeding roller R4 and the continuous paper sheet S becomes large in order to suppress the paper feeding roller R4 and the continuous paper sheet S from slipping on each other.

The continuous paper sheet S sent out from the paper feeding mechanism U2*c* is inserted between conveying rollers Ra arranged at an inlet of the main printer body U1. The conveying rollers are examples of conveying members. On the right side of the conveying rollers Ra, guide rollers Rb which are examples of guide members are arranged. The guide rollers Rb of the first example are configured in a rotatable roll shape.

On the downstream side from the secondary transfer roller T2*b* in the conveyance direction of the continuous paper sheet S, an idler roller R6 which is an example of a guide member is arranged. The idler roller R6 is arranged so as to come in contact with the lower surface of the continuous paper sheet 5, i.e. the opposite surface to the surface having images transferred thereon. The idler roller R6 is configured to be rotatable in a state where it is supports the continuous paper sheet S.

On the downstream side from the idler roller R6, a fixing unit F is arranged. The fixing unit F includes a heating roller Fh which is an example of a first fixing member and is also an example of a heating member, and a pressing roller Fp which is an example of a second fixing member and is also an example of a pressing member. The heating roller Fh contains a heater h which is an example of a heat source.

On the downstream side from the fixing unit F, the withdrawing unit U3 is arranged. The withdrawing unit U3 includes a cooling mechanism U3*a*. The cooling mechanism U3*a* includes a first cooling roller R11 which is an example of a first medium cooling member, and a second cooling roller R12 which is an example of a second medium cooling member. The second cooling roller R12 is arranged on the downstream side from the first cooling roller R11 in the conveyance direction of the continuous paper sheet S. The continuous paper sheet S is wound around the cooling rollers R11 and R12, thereby coming into contact with them.

On the downstream side from the cooling mechanism U3*a* in the conveyance direction of the continuous paper sheet 5, a guide roller Rb and conveying rollers R13 which are examples of conveying members are sequentially arranged. The conveying rollers R13 convey the continuous paper sheet S to the downstream side.

On the downstream side from the conveying rollers R13 in the conveyance direction of the continuous paper sheet 5, a second tension adjustment mechanism U3*b* is arranged. The second tension adjustment mechanism U3*b* is configured similarly to the first tension adjustment mechanism U2*b*. Therefore, the second tension adjustment mechanism includes a pair of guide rollers R14 and a dancer roller R15.

On the downstream side from the second tension adjustment mechanism U3*b* in the conveyance direction of the continuous paper sheet S, a take-up roller U3*c* which is an example of a withdrawing member is arranged. Around the take-up roller U3*c*, the continuous paper sheet S is wound. Further, if the height of the dancer roller R15 becomes lower than a preset winding height, the take-up roller U3*c* rotates such that the continuous paper sheet S is wound around it, and if the height of the dancer roller R15 becomes higher than a preset stop height, the take-up roller stops such that the continuous paper sheet S is not wound around it.

Marking Operation

In the printer U, if image information is received from the personal computer PC via the print image server COM, a job which is an image forming operation is started. If the job is started, the photosensitive members Py to Po, the intermediate transfer belt B, and so on rotate.

The photosensitive members Py to Po are rotated by a drive source (not shown in the drawing).

To the chargers CCy to CCo, a preset voltage is applied, and the chargers charge the surfaces of the photosensitive members Py to Po.

The exposing units ROSy to ROSo output laser beams Ly, Lm, Lc, Lk, and Lo which are examples of beams for writing latent images, according to a control signal from the control unit C, thereby writing electrostatic latent images on the charged surfaces of the photosensitive members Py to Po.

The developing units Gy to Go develop the electrostatic latent images written on the surfaces of the photosensitive members Py to Po into visible images.

If the developers are consumed by developing of the developing units, the toner cartridges feed the developers.

If a primary transfer voltage is applied, the primary transfer rollers T1*y* to T1*o* transfer visible images formed on the surfaces of the photosensitive members Py to Po to the surface of the intermediate transfer belt B. The primary transfer voltage has the opposite polarity to the polarity which the developers are charged with.

After the primary transfer, the photosensitive-member cleaners CLy to CLo clean the remaining developers off the surfaces of the photosensitive members Py to Po.

While the intermediate transfer belt B passes through a primary transfer area where it faces the photosensitive members Py to Po, images are transferred onto the intermediate transfer belt so as to be stacked in the order of Y, M, C, and K. Then, the intermediate transfer belt passes through a secondary transfer area Q4 where it faces the secondary transfer unit T2. However, in the case of monochrome images, images having only one color are transferred to the intermediate transfer belt, and then the intermediate transfer belt is conveyed to the secondary transfer area Q4.

The conveying rollers Ra convey the continuous paper sheet S spread out from the feeder unit U2 to the downstream side. The guide rollers Rb guide the continuous paper sheet S to the secondary transfer area Q4.

In the secondary transfer unit T2, if a secondary transfer voltage is applied to the backup roller T2*a* via the contact roller T2*c*, the image on the intermediate transfer belt B is transferred to the continuous paper sheet S. The secondary transfer voltage has the same polarity as the preset polarity which the developers are charged with.

While the continuous paper sheet S passes through a fixing area Q5 where the heating roller Fh and the pressing roller Fp come into contact with the continuous paper sheet, the fixing unit F heats the continuous paper sheet while pressing it, thereby fixing the unfixed image to the surface of the continuous paper sheet S.

In the withdrawing unit U3, the continuous paper sheet S is cooled by the cooling rollers R11 and R12, and then the continuous paper sheet S is wound around the take-up roller U3*c*.

Description of Medium Cooling Members

Figure 2:
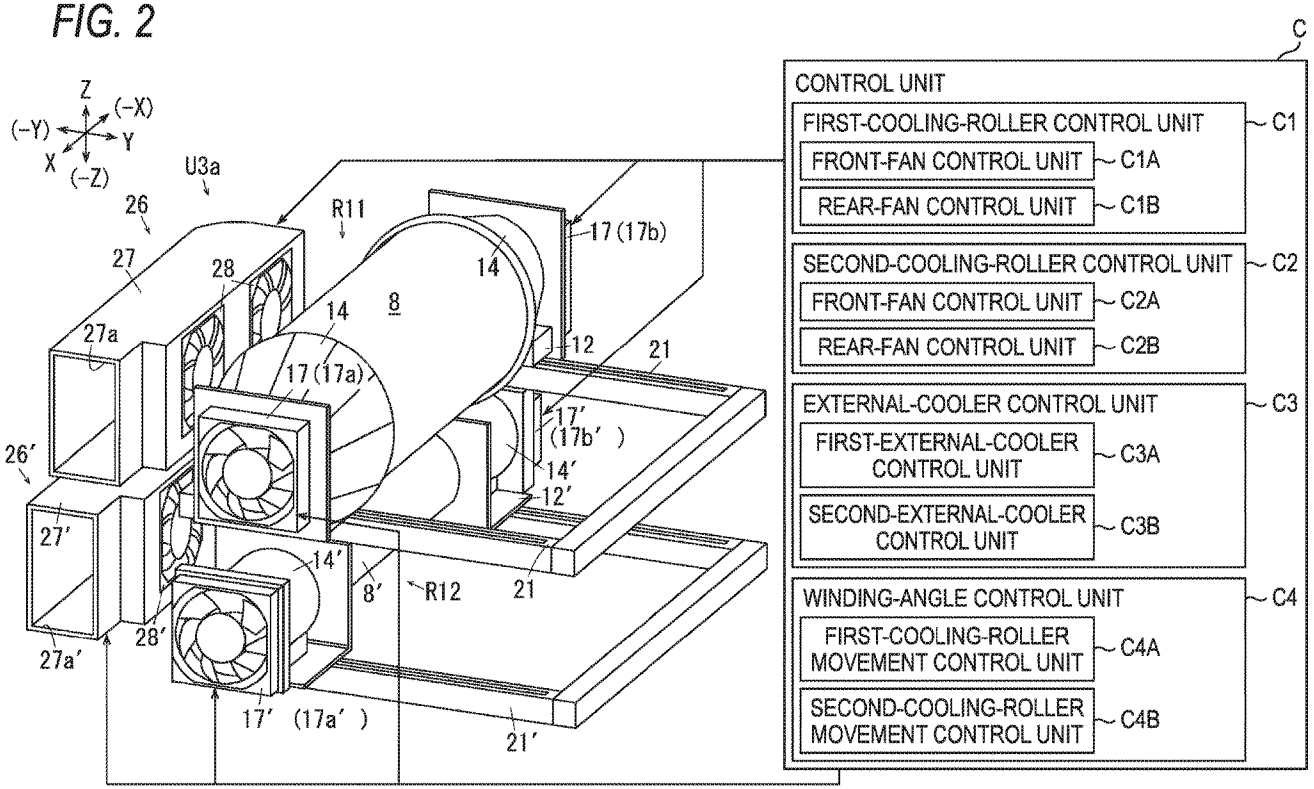
FIG. 2 is a perspective view illustrating a cooling mechanism of the first example.

FIG. 2 is a perspective view illustrating the cooling mechanism of the first example.

Figure 3A:
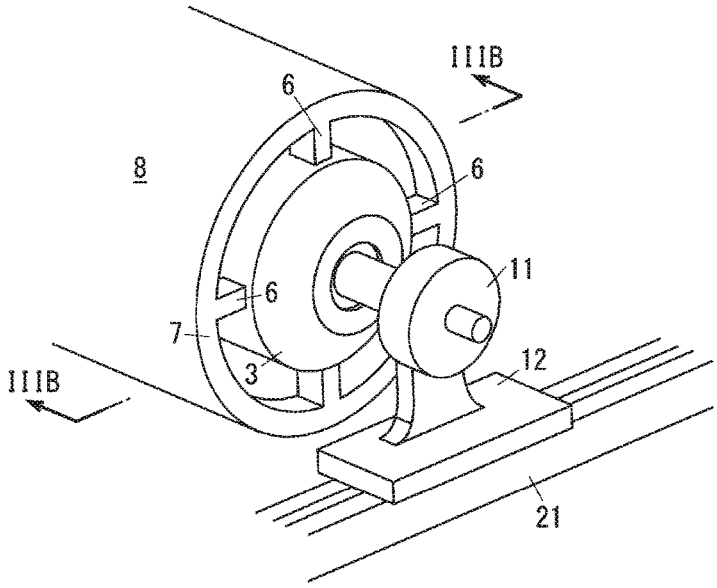
FIG. 3A is a view for explaining a main part of a medium cooling member of the first to third examples, and is a perspective view illustrating an end part.
Figure 3B:
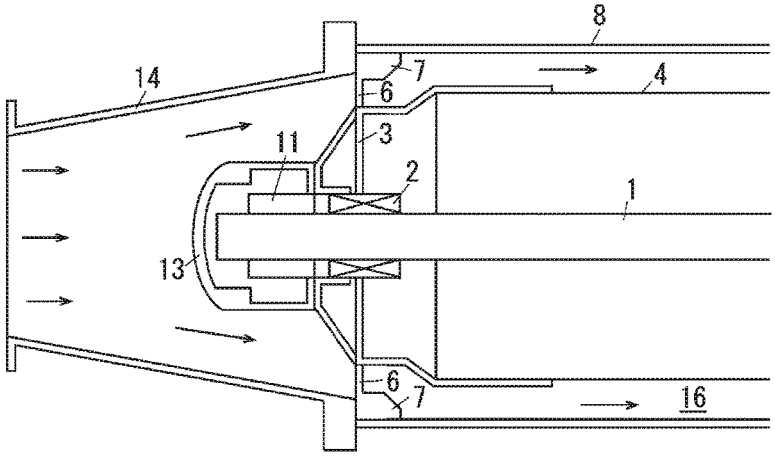
FIG. 3B is a cross-sectional view taken along a line IIIB-IIIB of FIG. 3A.

FIG. 3A is a perspective view illustrating an end part of a medium cooling member, and FIG. 3B is a cross-sectional view taken along a line IIIB-IIIB of FIG. 3A.

In FIG. 2. FIG. 3A, and FIG. 3B, in the cooling mechanism U3*a* which is an example of a medium cooling apparatus, the first cooling roller R11 which is an example of a first cooling unit has a shaft 1 which is an example of the center of rotation and extends in the axial direction. On both end parts of the shaft 1, hub units 3 which are examples of lid members and are also examples of supporting members of a guide member are supported with bearings 2 interposed therebetween so as to be rotatable. On the hub units 3, an inner cylinder 4 which is an example of a stirring unit and is also an example of a gas guide member is supported. The inner cylinder 4 has a cylindrical shape, in order words, a sleeve shape surrounding the shaft 1.

In FIG. 3A, to a hub unit 3, inner ends of spoke parts 6 in the radial direction are connected, and the spoke parts are examples of connection parts. The number of spoke parts 6 arranged in the radial direction is four.

To outer ends of the spoke parts 6 in the radial direction, a rim part 7 which is an example of support parts of a main body is connected. The rim part 7 have a circular shape (a ring shape) having the shaft 1 as the center.

On the rim part 7, an outer cylinder 8 which is an example of a rotary unit and is also an example of a cooling member is supported. The outer cylinder 8 has a cylindrical shape, in order words, a sleeve shape having the same the axis as that of the inner cylinder 4. The continuous paper sheet S is wound around the outer surface of the outer cylinder 8 of the first cooling roller R11, thereby coming into contact with the outer surface, and with conveyance of the continuous paper sheet 5, the outer cylinder 8 is rotated.

In FIG. 3A and FIG. 3B, on the outer sides from the hub units 3 in the axial direction, both end parts of the shaft 1 are supported on shaft supporting parts 11 which are examples of fixation support parts. In FIG. 3A, the lower ends of the shaft supporting parts 11 are supported on sliders 12 which are examples of movable members.

In FIG. 3B, on the shaft supporting parts 11, caps 13 which are examples of lid members and are also examples of gas guide members are supported. The caps 13 cover the outer sides of the shaft supporting parts 11 and the shaft 1 in the axial direction.

In FIG. 2 and FIG. 3B, on the sliders 12, end covers 14 which are examples of gas guide members are supported. The end covers 14 have hollow cone shapes having smaller inner diameters as going to ends in the axial direction.

Therefore, as shown in FIG. 3B, between the end covers 14 and the caps 13 and between the outer cylinder 8 and the inner cylinder 4, a passage 16 through which gas can pass from one end toward the other end in the axial direction is formed as an example of a gas passage.

On the outer sides of the end covers 14 in the axial direction, fans 17 which are examples of transfer members are supported. In the first cooling roller R11 of the first example, a front fan 17*a* which is an example of a first transfer member is supported on the front side in the axial direction, and a rear fan 17*b* which is an example of a second transfer member is supported on the rear side in the axial direction. Further, the front fan 17*a* is installed so as to transfer gas from the front side to the rear side during operation. Also, the rear fan 17*b* is installed so as to transfer gas from the rear side to the front side during operation.

In FIG. 2, the sliders 12 are supported on guide rails 21 which are examples of guide members of a cooling member, so as to be movable. The guide rails 21 extend along the left-right direction which is a direction intersecting with the axial direction (the front-rear direction), and support the sliders 12 such that the sliders can move in the left-right direction. The sliders 12 are supported such that the sliders can be moved along the guide rails 21 by a motor (not shown in the drawings). Therefore, according to user's inputs and settings, the first cooling roller R11 moves in the left-right direction, whereby it is possible to change (adjust) the winding angle of the continuous paper sheet S on the first cooling roller R11 (the winding amount, the amount of contact with the medium, or the contact area), and the tension of the continuous paper sheet S. Therefore, the sliders 12 and the guide rails 21 constitute an adjustment mechanism (12, 21) of the first example.

In FIG. 2, on the left side of the first cooling roller R11, a first external cooler 26 is supported. The first external cooler 26 is arranged so as to face the first cooling roller R11. The first external cooler 26 has a housing 27 which is an example of a case and extends along the axial direction of the first cooling roller R11. The housing 27 has an inlet 27*a* at the front end. In the housing 27, fans 28 which are examples of transfer members are arranged. The fans 28 are arranged in the axial direction of the first cooling roller R11. Therefore, the fans 28 blow gas onto the outer surface of the outer cylinder 8.

In FIG. 2, the second cooling roller R12 of the first example has the same configuration as that of the first cooling roller R11. In other words, the second cooling roller has a double cylinder structure having an inner cylinder 4' (not shown in the drawing) and an outer cylinder 8', and has fans 17*a*' and 17*b*' (only the front fan shown in the drawing) is arranged at both ends in the front-rear direction. Also, in the first example, as the fans (second transfer members) 17*a*' and 17*b*' of the second cooling roller R12, fans which are identical to the first cooling fans (first transfer members) 17*a* and 17*b* in the specifications such as the fan diameter are used, such that it becomes possible to use common components. Also, in the second cooling roller R12, sliders 12' are supported so as to be slidable along guide rails 21' in the left-right direction.

Also, in the first example, the inner cylinder 4' and the outer cylinder 8' of the second cooling roller R12 which is an example of a second cooling unit have diameters smaller than those of the first cooling roller R11. Therefore, as compared to the first cooling roller R11, the second cooling roller R12 has lower capability in cooling the continuous paper sheet S. In other words, the amount of heat which the second cooling roller absorbs from the continuous paper sheet S is smaller, i.e. the amount of heat which the second cooling roller dissipates from the continuous paper sheet S is smaller.

Also, in the second cooling roller R12 of the first example, unlike the outer cylinder 8 of the first cooling roller R11, since the outer surface of the outer cylinder 8' comes into contact with the surface of the continuous paper sheet S having images transferred and fixed thereon, on the outer cylinder, a release layer hard to be contaminated with the developers is formed. The release layer may have an arbitrary configuration according to required releasability, and it is possible to coat the outer cylinder with a fluorine resin, and it is also possible to roughen the surface layer of the outer cylinder and use the rough surface layer as the release layer. However, in the first cooling roller R11 of the first example, it is also possible to make the outer cylinder 8 of aluminum and expose the outer cylinder without forming a release layer on the surface thereof.

Also, a second external cooler 26' is arranged corresponding to the second cooling roller R12. The second external cooler 26' of the first example has fans (second transfer members) 28' having the same specifications as those of the fans (first transfer members) 28 of the first external cooler 26. The second external cooler 26' of the first example faces the second cooling roller R12 with the continuous paper sheet S interposed therebetween. Therefore, unlike the first external cooler 26, the second external cooler 26' blows gas onto the continuous paper sheet S to cool the continuous paper sheet. Therefore, outlets of the fans 28' of the second external cooler 26' are covered with filters for preventing the continuous paper sheet S from being contaminated.

Description of Control Unit of First Example

In FIG. 2, the individual fans 17, 17', 28, and 28' of the first example are controlled by the control unit C (which is an example of a control unit) of the printer U. The control unit C has an input/output interface I/O for performing reception of signals from the outside, output of signals to the outside, and so on. Also, the control unit C has a read only memory (ROM) retaining programs for performing necessary processing, information, and so on. Further, the control unit C has a random access memory (RAM) for temporarily storing necessary data. Furthermore, the control unit C has a central processing unit (CPU) for performing processing according to programs stored in the ROM and the like.

Therefore, the control unit C of the first example is configured with a small-sized information processing apparatus called a microcomputer. Therefore, the control unit C can implement various functions by executing programs stored in the ROM and the like.

Function of Control Unit C

The control unit C has a first-cooling-roller control unit C1 which is an example of a first-cooling-member control unit. The first-cooling-roller control unit C1 includes a front-fan control unit C1A and a rear-fan control unit C1B.

The front-fan control unit C1A controls operating and stopping of the front fan 17*a*. The front-fan control unit C1A of the first example operates and stops the front fan 17*a* at preset intervals during an image forming operation. In the first example, the front-fan control unit C1A repeats operating and stopping of the front fan 17*a* at intervals of one minute which is an example of preset intervals.

The rear-fan control unit C1B controls operating and stopping of the rear fan 17*b*. The rear-fan control unit C1B of the first example stops and operates the rear fan 17*b* in tandem with operating and stopping of the front fan 17*a*.

Therefore, in the first example, the front fan 17*a* and the rear fan 17*b* are controlled such that one of them operates and the other does not operate (they operate in turn). Therefore, while the front fan 17*a* operates (the rear fan 17*b* does not operate), gas flows in the passage 16 of the first cooling roller R11 from the front side to the rear side; whereas while the rear fan 17*b* operates (the front fan 17*a* does not operate), gas flows in the passage 16 from the rear side to the front side.

Also, the control unit C includes a second-cooling-roller control unit C2, which has a front-fan control unit C2A and a rear-fan control unit C2B similarly to the first-cooling-roller control unit C1. The front-fan control unit C2A and the rear-fan control unit C2B operate and stop the front fan 17*a*' and the rear fan 17*b*' in turn at preset intervals, similarly to the front-fan control unit C1A and the rear-fan control unit C1B of the first-cooling-roller control unit C1 described above.

Further, the control unit C includes an external-cooler control unit C3, which has a first-external-cooler control unit C3A and a second-external-cooler control unit C3B and operates the individual external cooler 26 and 26' during an image forming operation. The external-cooler control unit C3 of the first example performs control such that a fan 28 of the first external cooler 26 rotates at a speed higher than the rotation speed of a fan 28' of the second external cooler 26'. Therefore, the cooling capability, i.e. heat dissipation performance of the first cooling roller R11 is higher than that of the second cooling roller R12.

Figure 4A:
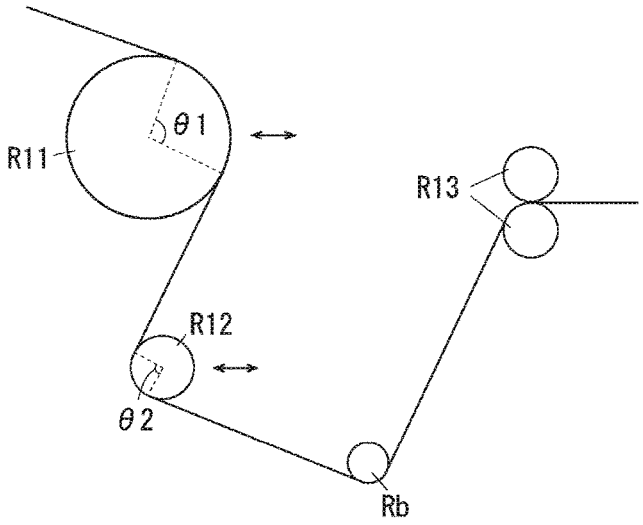
FIG. 4A is a view for explaining winding-angle adjustment of the first example and is a view for explaining a state where sliders have moved to the left side.
Figure 4B:
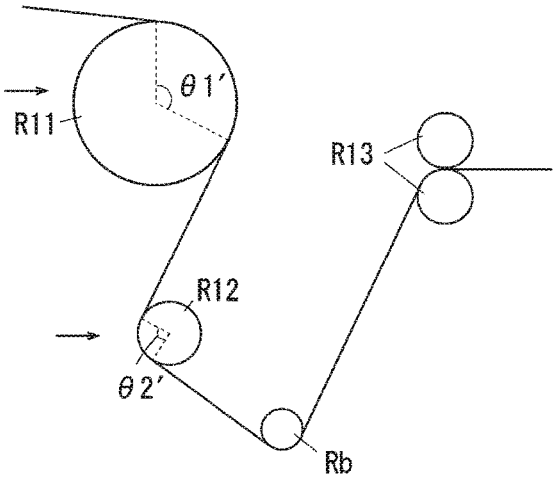
FIG. 4B is a view for explaining winding-angle adjustment of the first example and is a view for explaining a state where the sliders have moved to the right side.

FIG. 4A is a view for explaining winding-angle adjustment of the first example and is a view for explaining a state where the sliders have moved to the left side. FIG. 4B is a view for explaining a state where the sliders have moved to the right side.

A winding-angle control unit C4 has a first-cooling-roller movement control unit C4A and a second-cooling-roller movement control unit C4B, and controls winding angles of the continuous paper sheet S on the individual cooling rollers R11 and 112 by moving the sliders 12 and 12'. According to a cooling capability adjustment instruction input to an input unit (not shown in the drawings) of the printer U, the winding-angle control unit C4 of the first example changes (adjusts) the winding angles of the continuous paper sheet S on the individual cooling rollers R11 and R12 by moving the cooling rollers R11 and R12 in the left-right direction. In a state where the second cooling roller R12 is fixed, as the first cooling roller R11 is moved to the right side, the winding angle θ1 on the first cooling roller R11 increases, whereby the cooling performance improves. Also, in a state where the first cooling roller R11 is fixed, as the second cooling roller R12 is moved to the right side, the winding angle θ2 on the second cooling roller R12 decreases, whereby the cooling capability deteriorates. By individually moving the first cooling roller R11 and the second cooling roller R12, it is possible to adjust the winding angles θ1 and θ2 on the individual cooling rollers R11 and R12 and it is possible to adjust the cooling performance.

Effects of First Example

In the printer U of the first example having the above-described configuration, if a job which is an example of an image forming operation is started, images are transferred and fixed to the continuous paper sheet S. During fixing, if a part of the continuous paper sheet S heated in the fixing unit F reaches the cooling rollers R11 and R12, the continuous paper sheet S comes into contact with the cooling rollers R11 and R12 and is cooled.

In a configuration in which each of the cooling rollers is cooled from one side in the axial direction by a fan, the upstream side is cooled by colder air, and since air gets warmer as it goes to the downstream side, it becomes difficult to cool the downstream sides of the outer cylinders 8 and 8'. Therefore, between both sides of each cooling roller in the axial direction, time-dependent difference in cooling performance occurs. Therefore, between both sides of the paper sheet in the width direction, unevenness in cooling, i.e. unevenness in temperature occurs. Therefore, such as unevenness in gloss and sticking of the paper are feared.

In contrast, in the printer U of the first example, the fans 17 and 17' of the cooling rollers R11 and R12 produce a flow of gas from the front side and the rear side, in turn, thereby cooling the outer cylinders 8 and 8'. Therefore, as compared to the case of blowing gas from a specific direction (from only the front side or from only the rear side) to promote dissipation of heat from the cooling rollers R11 and R12, it is possible to suppress unevenness in the width direction of the continuous paper sheet S in cooling the continuous paper sheet S. Therefore, it is also possible to suppress occurrence of defects in the qualities of formed images and occurrence of sticking of the continuous paper sheet S.

Further, in the printer U of the first example, the outer cylinder 8 which comes into contact with the continuous paper sheet S contains the inner cylinder 4. Therefore, the flow of gas is guided into the outer cylinder 8. Especially, in the first example, since the hub units 3 and the caps 13 suppress gas from flowing into the inner cylinder 4, most of gas is guided into the outer cylinder 8. In a configuration having no inner cylinder 4, gas flows around the shaft 1, and the volume of gas flowing around the outer cylinder 8 required to be cooled decreases. Therefore, as compared to a configuration which does not have the inner cylinders 4 and 4', in the cooling rollers R11 and R12 of the first example having the inner cylinders 4 and 4', the cooling performance improves.

Also, in the printer U of the first example, the first cooling roller R11 is cooled even from the outside by the first external cooler 26. Therefore, as compared to a configuration which does not have the first external cooler 26, the cooling performance improves. Also, in general, a cooling roller absorbs heat at a part which is in contact with a paper sheet and dissipates heat at the other part which is not in contact with the paper sheet. In the case of using cut paper sheets, between a preceding paper sheet and the next paper sheet, there is a period when a cooling roller does not come into contact with any paper sheet, and thus the cooling roller has many opportunities to dissipate heat. However, a continuous paper sheet continues to come into contact with a cooling roller, and if the winding angle of a continuous paper sheet S on a cooling roller increases, the area of a part of the cooling roller which is not in contact with the paper sheet decreases, it becomes difficult to dissipate heat, and thus the cooling performance is likely to deteriorate. Therefore, in a configuration which does not have the first external cooler 26, the cooling performance is especially likely to deteriorate. However, in the first example, the first external cooler 26 makes it easy to maintain the cooling performance.

Further, in the first example, since the two cooling rollers R11 and R12 are used, as compared to the case of using only one cooling roller, the cooling efficiency improves.

Also, in the cooling rollers R11 and R12 of the first example, the first cooling roller R11 of the upstream side comes into contact with the opposite surface of the continuous paper sheet S to the surface having images transferred and fixed thereon (the image surface), and the second cooling roller R12 comes into contact with the image surface. In a configuration in which the cooling roller of the upstream side comes into contact with the image surface, in a state where the continuous paper sheet has not been sufficiently cooled, the cooling roller comes into contact with the image surface, and thus image quality deterioration such as image missing is more likely to occur. However, in the first example, since the first cooling roller R11 of the upstream side comes into contact with the non-image surface, occurrence of image quality deterioration is suppressed.

In the cooling rollers R11 and R12 of the first example, the first cooling roller R11 of the upstream side is a larger outer diameter, and thus has cooling capability higher than that of the second cooling roller R12 of the downstream side.

In the first example, the first cooling roller R11 of the upstream side has a larger diameter and has higher cooling performance. Therefore, as compared to the case where two cooling rollers have the same outer diameter and the case where a cooling roller of the downstream side has a larger outer diameter, the cooling efficiency is likely to improve. Therefore, such as image missing and sticking is suppressed.

Also, in the first example, the second cooling roller R12 has the release layer as its surface layer, and the first cooling roller R11 has no release layer. In general, in the case where a release layer is formed of a resin on a cooling roller made from a metal sheet, if the resin has heat conductivity lower than that of the metal sheet, or if the surface of the cooling roller is roughened, whereby the area of contact of the cooling roller and a continuous paper sheet S decreases, the rate of heat transfer from the continuous paper sheet S to the cooling roller is likely to decrease. Therefore, in the first example, the first cooling roller R11 of the upstream side having no release layer has higher cooling performance and absorbs a larger amount of heat as compared to the second cooling roller R12 of the downstream side.

Further, in the first example, control is performed such that the rotation speed of the first external cooler 26 of the upstream side becomes higher than that of the second external cooler 26' of the downstream side and the first external cooler blows more gas. Therefore, the first cooling roller R11 is likely to be cooled. Therefore, as compared to the case where the volume of gas from the first external cooler 26 is small, the temperature difference between the first cooling roller R11 and the continuous paper sheet S increases, and thus the cooling performance improves.

Also, in the first example, the winding angles θ1 and θ2 are controlled such that the cooling performance of the first cooling roller R11 of the upstream side becomes higher. Therefore, in the first example, as a whole, the cooling performance of the first cooling roller R11 of the upstream side is set to be higher than that of the second cooling roller R12 of the downstream side.

Also, in the first example, by adjusting the volumes of gas from the fans 28 and 28' of the external coolers 26 and 26' and the positions of the sliders 12 and 12', it is possible to adjust the cooling performance (the amounts of heat absorption) of the first cooling roller R11 and the second cooling roller R12. In some cases, such as the case where switching from a continuous paper sheet S of a plain paper type to a thin paper type or a thick paper type has been performed and the case where the individual members have deteriorated with time, it is required to adjust the cooling performance. In such a case, it is possible to adjust the cooling performance.

Also, in the cooling rollers R11 and R12 of the first example, after the continuous paper sheet is cooled the first cooling roller R11 of the upstream side, the image surface is also cooled by the second cooling roller R12 of the downstream side. Therefore, as compared to the case where the image surface side is not cooled, the developers on the image surface are also likely to be sufficiently cooled. Therefore, while the continuous paper sheet is in contact with the conveying rollers R13 to R15 of the downstream side, image missing is unlikely to occur, and in a state where the continuous paper sheet has been wound around the take-up roller U3*c*, the developers are unlikely to stick to parts of the continuous paper sheet S overlapping the developers.

Especially, in the first example, since the second cooling roller R12 has the release layer, parts of images are unlikely to stick to the second cooling roller R12, and thus occurrence of image missing is also suppressed.

SECOND EXAMPLE

Hereinafter, the second example will be described. Components identical to those of the first example are denoted b the same reference symbols.

Description of Medium Cooling Members

Figure 5:
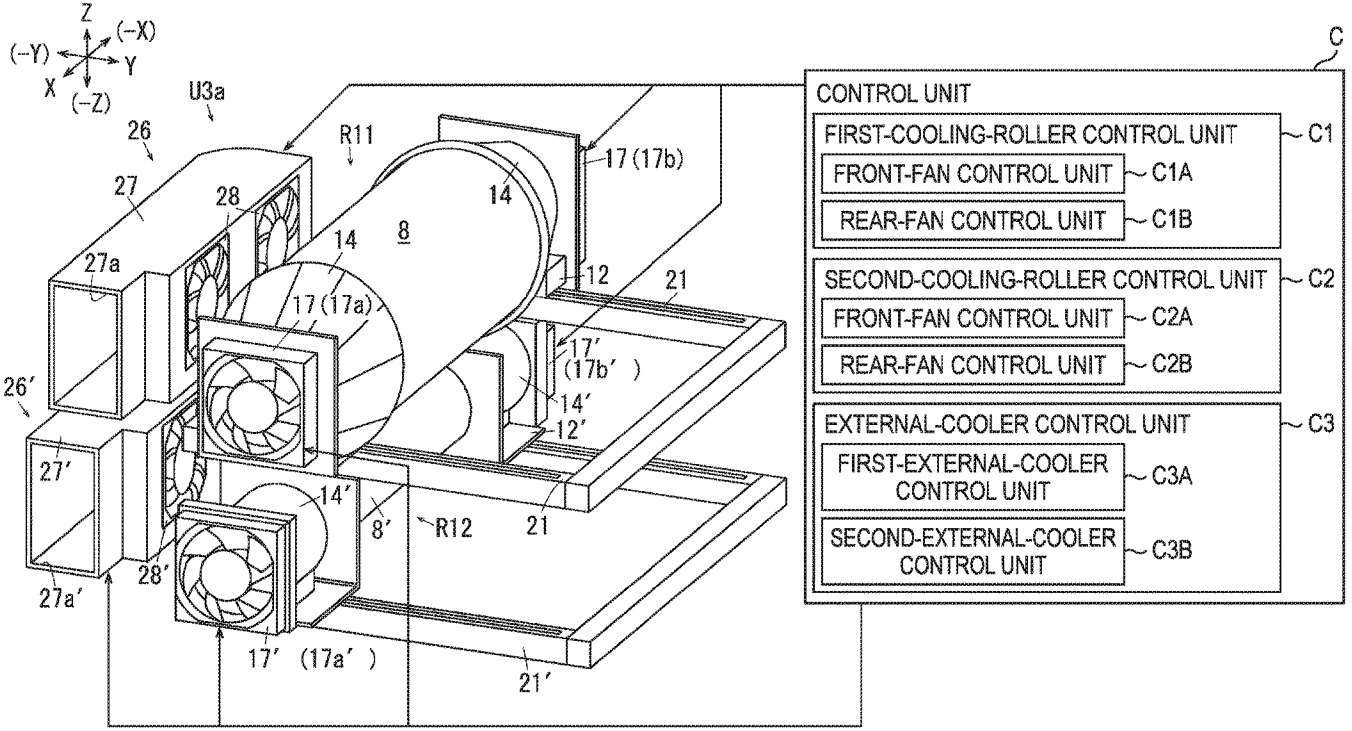
FIG. 5 is a perspective view illustrating a cooling mechanism of the second example.

FIG. 5 is a perspective view illustrating a cooling mechanism of the second example.

Figure 6:
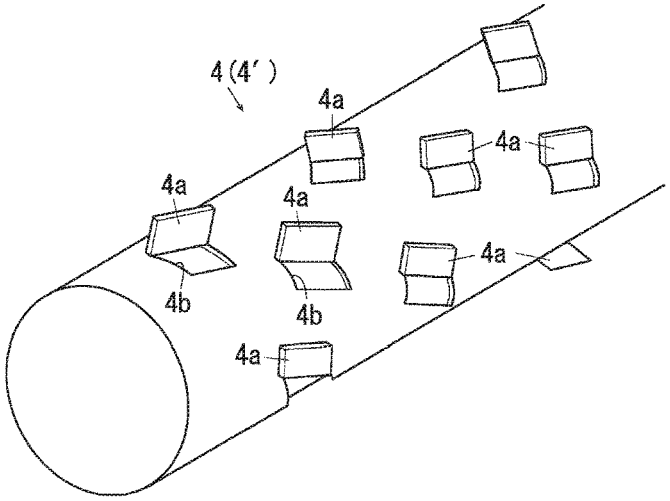
FIG. 6 is a view for explaining an inner cylinder of the second example.

FIG. 6 is a view for explaining an inner cylinder of the second example.

In FIG. 6, an inner cylinder 4 of the second example has projections 4*a*. The projections 4*a* of the second example are formed by making cuts 4*b* in the outer periphery of the inner cylinder 4 and bending the cut parts outward in the radial direction. As shown in FIG. 6, the projections 4*a* are arranged at intervals along a spiral turning around the central axis of the inner cylinder 4 (the shaft 1). Therefore, the projections 4*a* of the second example are formed in plate shapes inclined with respect to the axial direction of the inner cylinder 4.

Description of Control Unit of Second Example

In FIG. 5, the individual fans 17 and 28 of the second example are controlled by the control unit C (which is an example of the control unit) of the printer U. The control unit C has an input/output interface I/O for performing reception of signals from the outside, output of signals to the outside, and so on. Also, the control unit C has a read only memory (ROM) retaining programs for performing necessary processing, information, and so on. Further, the control unit C has a random access memory (RAM) for temporarily storing necessary data. Furthermore, the control unit C has a central processing unit (CPU) for performing processing according to programs stored in the ROM and the like. Therefore, the control unit C of the second example is configured with a small-sized information processing apparatus called a microcomputer. Therefore, the control unit C can implement various functions by executing programs stored in the ROM and the like.

Function of Control Unit C

The control unit C has a first-cooling-roller control unit C1 which is an example of the first-cooling-member control unit. The first-cooling-roller control unit C1 includes a front-fan control unit C1A and a rear-fan control unit C1B.

The front-fan control unit C1A controls operating and stopping of the front fan 17*a*. The front-fan control unit C1A of the second example operates and stops the front fan 17*a* at preset intervals during an image forming operation. In the second example, the front-fan control unit C1A repeats operating and stopping of the front fan 17*a* at intervals of one minute which is an example of preset intervals.

The rear-fan control unit C1B controls operating and stopping of the rear fan 17*b*. The rear-fan control unit C1B of the second example stops and operates the rear fan 17*b* in tandem with operating and stopping of the front fan 17*a*.

Therefore, in the second example, the front fan 17*a* and the rear fan 17*b* are controlled such that one of them operates and the other stops. Therefore, while the front fan 17*a* operates (the rear fan 17*b* does not operate), gas flows in the passage 16 of the first cooling roller R11 from the front side to the rear side; whereas while the rear fan 17*b* is operates (the front fan 17*a* does not operate), gas flows in the passage 16 from the rear side to the front side.

Also, the control unit C includes a second-cooling-roller control unit C2, which has a front-fan control unit C2A and a rear-fan control unit C2B similarly to the first-cooling-roller control unit C1. The front-fan control unit C2A and the rear-fan control unit C2B operate and stop the front fan 17*a*' and the rear fan 17*b*' in turn at preset intervals, similarly to the front-fan control unit C1A and the rear-fan control unit C1B of the first-cooling-roller control unit C1 described above.

The control unit C includes an external-cooler control unit C3, which operates the individual external cooler 26 and 26' during an image forming operation.

Effects of Second Example

In the printer U of the second example having the above-described configuration, if a job which is an example of an image forming operation is started, images are transferred and fixed to the continuous paper sheet S. During fixing, if a part of the continuous paper sheet S heated in the fixing unit F reaches the cooling rollers R11 and R12, the continuous paper sheet S comes into contact with the cooling rollers R11 and R12 and is cooled.

In the printer U of the second example, while the cooling rollers R11 and R12 rotate, with rotation of the outer cylinders 8 and 8', the inner cylinders 4 and 4' also rotate integrally. Therefore, the projections 4*a* of the inner cylinders 4 and 4' rotate inside the passage 16, and thus gas in the passage 16 is stirred. Of gas flowing in the passage 16, gas around the outer cylinders 8 and 8' is likely to get warmer when cooling the outer cylinders 8 and 8'; whereas gas around the inner cylinders 4 and 4' is unlikely to get warmer. Therefore, if the gas in the passage 16 is stirred, cold gas around the inner cylinders 4 and 4' is likely to be sent to the vicinities of the outer cylinders 8 and 8'. Therefore, as compared to the case where the gas in the passage is not stirred, even on the downstream side in the gas transfer direction, the outer cylinders 8 and 8' are likely to be cooled. Therefore, in the cooling rollers R11 and R12 of the second example, as compared to the configuration in which the inner cylinders 4 and 4' does not have the projections 4*a*, unevenness in temperature is unlikely to occur in the axial directions of the cooling rollers R11 and R12. Therefore, occurrence of defects in image quality such as unevenness in gloss is also suppressed.

Especially, in the cooling rollers R11 and R12 of the second example, the projections 4*a* are arranged along a spiral. Therefore, the projections 4*a* stir the gas, thereby generating a vortex going toward the downstream side. Therefore, the flow of gas becomes faster, and it becomes easier to transfer cold gas on the upstream side to the downstream side. Therefore, as compared to the case where the projections are arranged in any other shape, not along a spiral, occurrence of unevenness in temperature in the axial direction is suppressed.

Also, in the cooling rollers 111 and R12 of the second example, the fans 17 and 17' are arranged so as to function as intake fans for transferring gas from the outside of the cooling rollers R11 and R12 into the cooling rollers. Therefore, the projections 4*a* are positioned on the downstream side from the fans 17 and 17' in the gas transfer direction. In the case where the fans 17 and 17' are exhaust fans, the projections 4*a* are positioned on the upstream side in the gas transfer direction. When the fans 17 and 17' rotate, with rotation of the blades of the fans 17 and 17', gas is likely to become a vortex state or a turbulence state. Therefore, in the case where the projections 4*a* are positioned on the downstream side from the fans 17 and 17', since the gas in the vortex state is further stirred by the projections 4*a*, an improvement in the stirring effect is expected. Therefore, as compared to the case where the projections 4*a* are positioned on the upstream side from the fans 17 and 17', in the second example, an improvement in the effect of stirring is expected.

Also, in the cooling rollers R11 and R12 of the second example, the fans 17 and 17' produce gas flows from the front side and the rear side, in turn, thereby cooling the outer cylinders 8 and 8'. Therefore, as compared to the case of producing gas flows from one specific direction (from only the front side or from only the rear side) to promote dissipation of heat from the cooling rollers R11 and R12, it is possible to suppress unevenness in the width direction of the continuous paper sheet S in cooling the continuous paper sheet S. Therefore, it is also possible to suppress occurrence of defects in the image quality of formed images and occurrence of sticking of the continuous paper sheet S.

Further, in the printer U of the second example, the outer cylinder 8 which comes into contact with the continuous paper sheet S contains the inner cylinder 4. Therefore, the flow of gas is guided into the outer cylinder 8. Especially, in the second example, since the hub units 3 and the caps 13 suppress gas from flowing into the inner cylinder 4, most of gas is guided into the outer cylinder 8. In a configuration having no inner cylinder 4, gas flows around the shaft 1, and the volume of gas flowing around the outer cylinder 8 required to be cooled decreases. Therefore, as compared to a configuration which does not have the inner cylinders 4 and 4', in the cooling rollers R11 and R12 of the second example having the inner cylinders 4 and 4', the cooling performance improves.

Also, in the printer U of the second example, the first cooling roller R11 is cooled even from the outside by the first external cooler 26. Therefore, as compared to a configuration which does not have the first external cooler 26, the cooling performance improves. Also, in general, a cooling roller absorbs heat at a part which is in contact with a paper sheet and dissipates heat at the other part which is not in contact with the paper sheet. In the case of using cut paper sheets, between a preceding paper sheet and the next paper sheet, there is a period when a cooling roller does not come into contact with any paper sheet, and thus the cooling roller has many opportunities to dissipate heat. However, a continuous paper sheet continues to come into contact with a cooling roller, and if the winding angle of a continuous paper sheet S on a cooling roller increases, the area of a part of the cooling roller which is not in contact with the paper sheet decreases, it becomes difficult to dissipate heat, and thus the cooling performance is likely to deteriorate. Therefore, in a configuration which does not have the first external cooler 26, the cooling performance is especially likely to deteriorate. However, in the second example, the first external cooler 26 makes it easy to maintain the cooling performance.

Further, in the second example, since the two cooling rollers R11 and R12 are used, as compared to the case of using only one cooling roller, the cooling efficiency improves.

Also, in the cooling rollers R11 and R12 of the second example, the first cooling roller R11 of the upstream side comes into contact with the opposite surface of the continuous paper sheet S to the surface having images transferred and fixed thereon (the image surface), and the second cooling roller R12 comes into contact with the image surface. In a configuration in which the cooling roller of the upstream side comes into contact with the image surface, in a state where the continuous paper sheet has not been sufficiently cooled, the cooling roller comes into contact with the image surface, and thus image quality deterioration such as image missing is more likely to occur. However, in the second example, since the cooling roller R11 of the upstream side comes into contact with the non-image surface, occurrence of image quality deterioration is suppressed.

In the cooling rollers R11 and R12 of the second example, the diameter of the first cooling roller R11 of the upstream side is larger, and thus has cooling capability higher than that of the second cooling roller R12 of the downstream side.

In the case of using cooling rollers having the same diameter, the cooling rollers have the same cooling performance. Also, in the case where a larger winding angle is set for the cooling roller of the downstream side, the downstream side has higher cooling performance. Further, in general, as difference in temperature increases, heat conduction increases, and cooling efficiency is high, and the temperature of a continuous paper sheet S is higher on the upstream side. Therefore, in such a configuration, the cooling efficiency of the entire configuration lowers. Therefore, in a state where a continuous paper sheet has not been sufficiently cooled by the cooling roller of the upstream side, the cooling roller of the downstream side may come into contact with the image surface of the continuous paper sheet, and image defects such as unevenness in gloss may occur.

In contrast, in the second example, the first cooling roller R11 of the upstream side has a larger diameter and has higher cooling performance. Therefore, as compared to the case where two cooling rollers have the same outer diameter and the case where a cooling roller of the downstream side has a larger outer diameter, the cooling efficiency is likely to improve. Therefore, such as image missing and sticking is suppressed.

Also, in the second example, the second cooling roller R12 has the release layer as its surface layer, and the first cooling roller R11 has no release layer. In general, in the case where a release layer is formed of a resin on a cooling roller made from a metal sheet, if the resin has heat conductivity lower than that of the metal sheet, or if the surface of the cooling roller is roughened, whereby the area of contact of the cooling roller and a continuous paper sheet S decreases, the rate of heat transfer from the continuous paper sheet S to the cooling roller is likely to decrease. Therefore, in the second example, the first cooling roller R11 of the upstream side having no release layer has higher cooling performance and absorbs a larger amount of heat as compared to the second cooling roller R12 of the downstream side.

Further, in the second example, the rotation speed of the first external cooler 26 of the upstream side can be set to be higher than that of the second external cooler 26' of the downstream side such that the first external cooler can blow more gas. In this case, the first cooling roller R11 is also likely to be cooled. Therefore, as compared to the case where the volume of gas from the first external cooler 26 is small, the temperature difference between the first cooling roller R11 and the continuous paper sheet S increases, and thus the cooling performance improves.

Also, in the second example, it is possible to control the winding angles θ1 and θ2 such that the cooling performance of the first cooling roller R11 of the upstream side becomes higher.

Also, in the second example, by adjusting the volumes of gas from the fans 28 and 28' of the external coolers 26 and 26' and the positions of the sliders 12, it is possible to adjust the cooling performance (the amounts of heat absorption) of the first cooling roller R11 and the second cooling roller R12. In some cases, such as the case where switching from a continuous paper sheet S of a plain paper type to a thin paper type or a thick paper type has been performed and the case where the individual members have deteriorated with time, it is required to adjust the cooling performance. In such a case, it is possible to adjust the cooling performance.

Also, in the cooling rollers R11 and R12 of the second example, after the continuous paper sheet is cooled the first cooling roller R11 of the upstream side, the image surface is also cooled by the second cooling roller R12 of the downstream side. Therefore, as compared to the case where the image surface side is not cooled, the developers on the image surface are also likely to be sufficiently cooled. Therefore, while the continuous paper sheet is in contact with the conveying rollers R13 to R15 of the downstream side, image missing is unlikely to occur, and in a state where the continuous paper sheet has been wound around the take-up roller U3*c*, the developers are unlikely to stick to parts of the continuous paper sheet S overlapping the developers.

Especially, in the second example, since the second cooling roller R12 has the release layer, parts of images are unlikely to stick to the second cooling roller R12, and thus occurrence of image missing is also suppressed.

First Modification of Second Example

Figure 7:
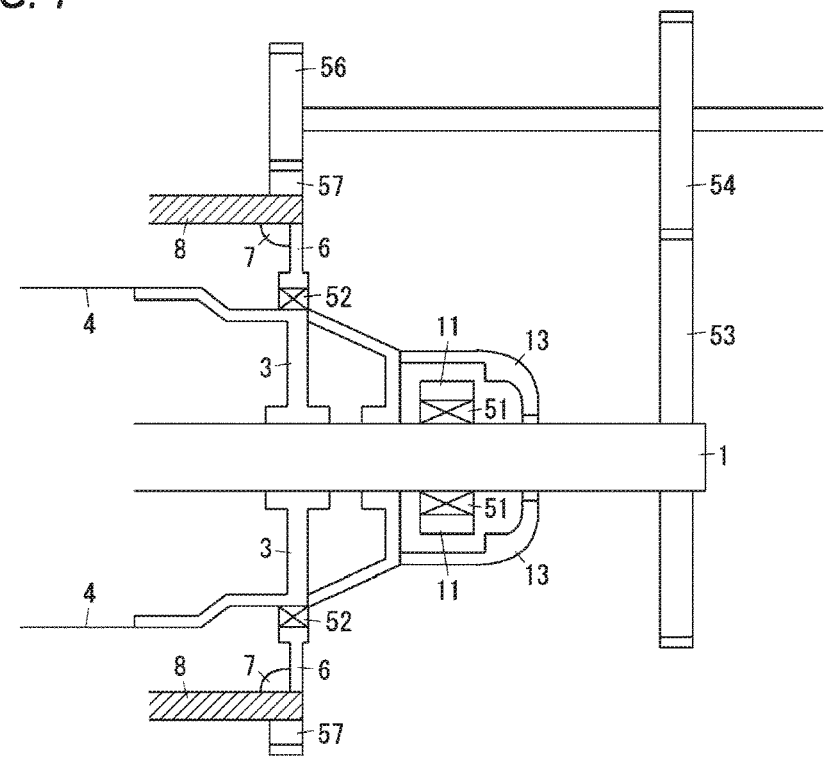
FIG. 7 is a view for explaining a modification of the second example.

FIG. 7 is a view for explaining a modification of the second example.

In the second embodiment, the configuration in which the inner cylinders 4 and 4' and the outer cylinders 8 and 8' rotate integrally has been described as an example; however, the inner cylinders and the outer cylinders are not limited thereto. For example, a configuration shown in FIG. 7 is also possible. In FIG. 7, on the shafts 1, the inner cylinders 4 and 4' and the hub units 3 and 3' are supported directly without the bearings 2 interposed therebetween. The shafts 1 are supported on shaft supporting parts 11 with bearings 51 interposed therebetween. The outer cylinders 8 and 8', the rim parts 7, and the spoke parts 6 are supported on the hub units 3 and 3' with bearings 52 interposed therebetween, so as to be rotatable. On the outer ends of the shafts 1, inner gears 53 are supported. The inner gears 53 are engaged with first intermediate gears 54. Second intermediate gears 56 are supported so as to have the same axes as those of the first intermediate gears 54. Also, shafts of the intermediate gears 54 and 56 are supported on a frame (not shown in the drawing) of the printer U so as to be rotatable. The second intermediate gears 56 are engaged with outer gear parts 57 formed on the outer peripheries of the rim parts 7. Therefore, in the configuration of the first modification of the second example, the inner cylinders 4 and 4' and the outer cylinders 8 and 8' rotate in the same direction; however, the numbers of teeth of the individual gears 53 to 57 are set such that the inner cylinders 4 and 4' rotate faster than the outer cylinders 8 and 8' do.

According to the configuration of the modification of the second example, in the case where the outer cylinders 8 and 8' are rotated with conveyance of a continuous paper sheet S, the inner cylinders 4 and 4' rotate at speeds different from those of the outer cylinders 8 and 8'. Therefore, in contrast with the case where the inner cylinders and the outer cylinders rotate integrally, it is possible to change the effect of stirring on the flow of gas. In other words, in the case where stirring is insufficient or excessive due to the conveyance speed and fixing temperature of a continuous paper sheet S, the volumes of gas from the fans 17 and 17', settings of the diameters of the cooling rollers R11 and R12, and the like, it is possible to adjust the degree of stirring by adjusting the numbers of teeth of the gears 53 to 57.

Also, for example, in the case where it is desired to rotate the inner cylinders 4 and 4' and the outer cylinders 8 and 8' in the opposite directions, for example, if an odd number of gears are added between each of the pairs of the inner gears 53 and the outer gear parts 57 such that the additional gears are engaged between them, it is possible to rotate the inner cylinders and the outer cylinders in the opposite directions.

Although the configuration in which the inner cylinders 4 and 4' rotate has been described, a configuration in which only the outer cylinders 8 and 8' rotate and the inner cylinders 4 and 4' does not rotate is also possible.

THIRD EXAMPLE

Hereinafter, the third example will be described. Components identical to those of the first example and the second example are denoted by the same reference symbols.

Description of Medium Cooling Members

Figure 8:
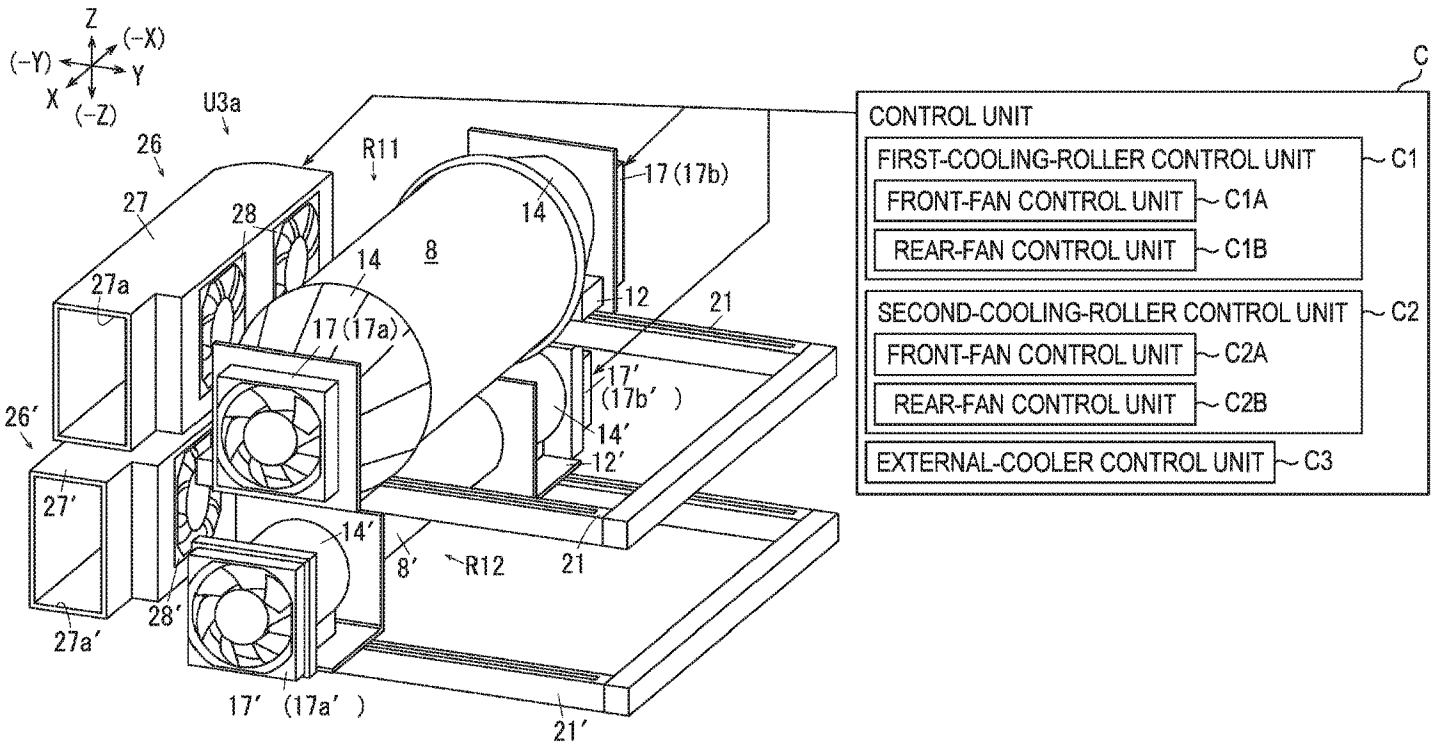
FIG. 8 is a perspective view illustrating a cooling mechanism of the third example.

FIG. 8 is a perspective view illustrating a cooling mechanism of the third example.

Description of Control Unit of Third Example

In FIG. 8, the individual fans 17, 17', 28, and 28' of the third example are controlled by the control unit C (which is an example of a control unit) of the printer U. The control unit C has an input/output interface I/O for performing reception of signals from the outside, output of signals to the outside, and so on. Also, the control unit C has a read only memory (ROM) retaining programs for performing necessary processing, information, and so on. Further, the control unit C has a random access memory (RAM) for temporarily storing necessary data. Furthermore, the control unit C has a central processing unit (CPU) for performing processing according to programs stored in the ROM and the like. Therefore, the control unit C of the third example is configured with a small-sized information processing apparatus called a microcomputer. Therefore, the control unit C can implement various functions by executing programs stored in the ROM and the like.

Function of Control Unit C

The control unit C has a first-cooling-roller control unit C1 which is an example of a first-cooling-member control unit. The first-cooling-roller control unit C1 includes a front-fan control unit C1A and a rear-fan control unit C1B.

The front-fan control unit C1A controls operating and stopping of the front fan 17*a*. The front-fan control unit C1A of the third example operates and stops the front fan 17*a* at preset intervals during an image forming operation. In the third example, the front-fan control unit C1A repeats operating and stopping of the front fan 17*a* at intervals of one minute which is an example of preset intervals.

The rear-fan control unit C1B controls operating and stopping of the rear fan 17*b*. The rear-fan control unit C1B of the third example stops and operates the rear fan 17*b* in tandem with operating and stopping of the front fan 17*a*.

Therefore, in the third example, the front fan 17*a* and the rear fan 17*b* are controlled such that one of them operates and the other stops. Therefore, while the front fan 17*a* operates (the rear fan 17*b* does not operate), gas flows in the passage 16 of the first cooling roller RH from the front side to the rear side; whereas while the rear fan 17*b* is operates (the front fan 17*a* does not operate), gas flows in the passage 16 from the rear side to the front side.

Similarly to the first-cooling-roller control unit C1, the second-cooling-roller control unit C2 of the control unit C has the front-fan control unit C2A and the rear-fan control unit C2B. The front-fan control unit C2A and the rear-fan control unit C2B operate and stop the front fan 17*a'* and the rear fan 17*b'* in turn at preset intervals, similarly to the front-fan control unit C1A and the rear-fan control unit C1B of the first-cooling-roller control unit C1 described above.

Also, the control unit C includes an external-cooler control unit C3, which operates the individual external cooler 26 and 26' during an image forming operation.

Effects of Third Example

In a configuration using a continuous paper sheet, since the paper sheet continues to come into contact with the cooling rollers, the temperatures of the cooling rollers are likely to rise. If the cooling capability deteriorates and the paper sheet is insufficiently cooled, when the paper sheet is in contact with the conveying rollers R13 to R15 on the downstream side from the cooling rollers, some parts of images are likely to stick to the conveying rollers (image missing is likely to occur), and image defects such as unevenness in gloss are likely to occur. Also, in the case where a paper sheet (a continuous paper sheet) cooled insufficiently is wound or in the case where paper sheets (cut paper sheets) are discharged onto a discharge tray, there is an object that images cooled insufficiently stick to parts of paper sheets superimposed thereon.

Figure 9:
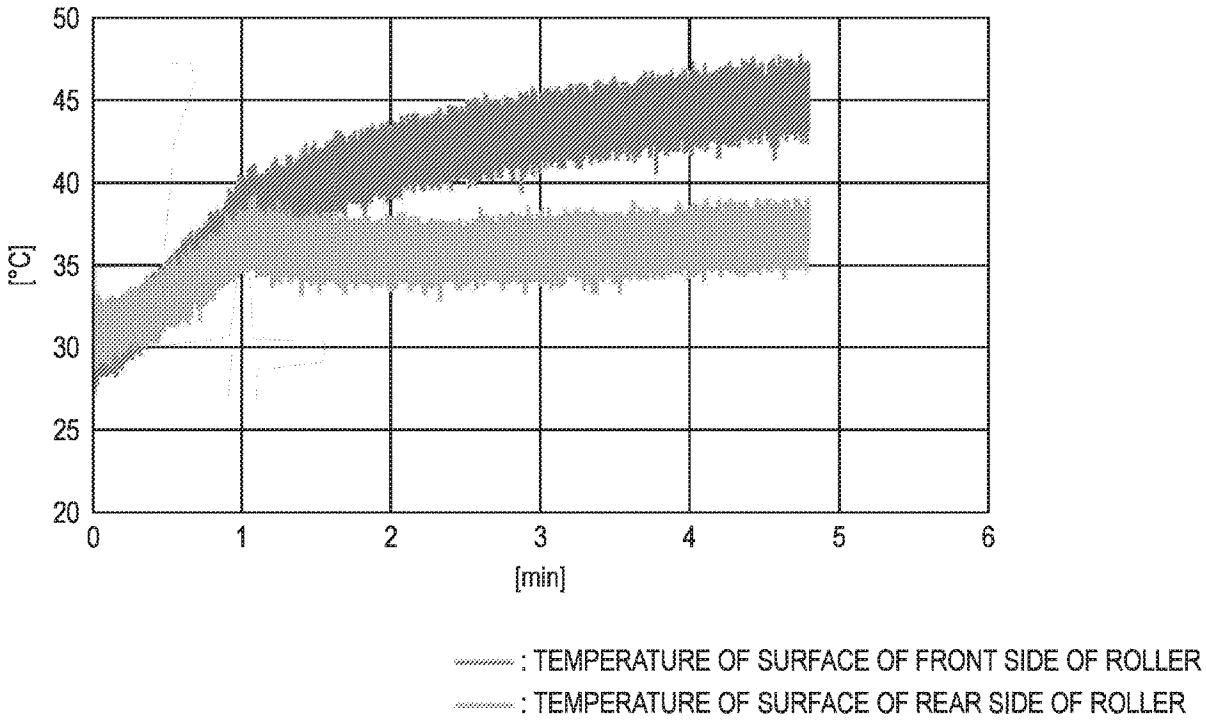
FIG. 9 is a view for explaining an experiment result of a comparative example, and is a graph in which the horizontal axis represents time and the vertical axis represents temperature.

FIG. 9 is a view for explaining an experiment result of a comparative example, and is a graph in which the horizontal axis represents time and the vertical axis represents temperature.

In FIG. 9, an experiment is conducted with a Color 1000 Press made by Fuji Xerox Co., Ltd. and remodeled. In the experiment, the conveyance speed of a continuous paper sheet is set to 500 m/s, and the roller diameter ϕ of the first cooling roller is set to 200 mm, and cooling is performed by only the front fan 17*a*. Also, temperature sensors are arranged on the front side and rear side of the cooling roller, and temperature is measured.

In FIG. 9, as the result of the experiment, until one minute elapses, between the front side and rear side of the cooling roller, temperature difference rarely occurs; however, after one minute elapses, between the front side and the rear side, temperature difference occurs, and as time goes on, the temperature difference becomes larger.

Therefore, as can be seen from the result shown in FIG. 9, in a configuration in which a cooling roller is cooled from one side in the axial direction by a fan, between both sides of each cooling roller in the axial direction, time-dependent difference in cooling performance occurs. Therefore, between both sides of the paper sheet in the width direction, unevenness in cooling, i.e. unevenness in temperature occurs. Therefore, such as unevenness in gloss and sticking of the paper are feared.

In contrast, in the printer U of the third example, the fans 17 and 17' of the cooling rollers R11 and R12 produce a flow of gas from the front side and the rear side, in turn, thereby cooling the outer cylinders 8 and 8'. Therefore, as compared to the case of blowing gas from a specific direction (from only the front side or from only the rear side) to promote dissipation of heat from the cooling rollers R11 and R12, it is possible to suppress unevenness in the width direction of the continuous paper sheet S in cooling the continuous paper sheet S. Therefore, it is also possible to suppress occurrence of defects in the qualities of formed images and occurrence of sticking of the continuous paper sheet S.

Further, in the printer U of the third example, the outer cylinder 8 which comes into contact with the continuous paper sheet S contains the inner cylinder 4. Therefore, the flow of gas is guided into the outer cylinder 8. Especially, in the third example, since the hub units 3 and the caps 13 suppress gas from flowing into the inner cylinder 4, most of gas is guided into the outer cylinder 8. In a configuration having no inner cylinder 4, gas flows around the shaft 1, and the volume of gas flowing around the outer cylinder 8 required to be cooled decreases. Therefore, as compared to a configuration which does not have the inner cylinders 4 and 4', in the cooling rollers R11 and R12 of the third example having the inner cylinders 4 and 4', the cooling performance improves.

Also, in the printer U of the third example, the first cooling roller R11 is cooled even from the outside by the first external cooler 26. Therefore, as compared to a configuration which does not have the first external cooler 26, the cooling performance improves. In general, a cooling roller absorbs heat at a part which is in contact with a paper sheet and dissipates heat at the other part which is not in contact with the paper sheet. In the case of using cut paper sheets, between a preceding paper sheet and the next paper sheet, there is a period when a cooling roller does not come into contact with any paper sheet, and thus the cooling roller has many opportunities to dissipate heat. However, a continuous paper sheet continues to come into contact with a cooling roller, and if the winding angle of a continuous paper sheet S on a cooling roller increases, the area of a part of the cooling roller which is not in contact with the paper sheet decreases, it becomes difficult to dissipate heat, and thus the cooling performance is likely to deteriorate. Therefore, in a configuration which does not have the first external cooler 26, the cooling performance is especially likely to deteriorate. However, in the third example, the first external cooler 26 makes it easy to maintain the cooling performance.

Further, in the third example, since the two cooling rollers R11 and R12 are used, as compared to the case of using only one cooling roller, the cooling efficiency improves.

Also, in the cooling rollers R11 and R12 of the third example, the first cooling roller R11 of the upstream side comes into contact with the opposite surface of the continuous paper sheet S to the surface having images transferred and fixed thereon (the image surface), and the second cooling roller R12 comes into contact with the image surface. In a configuration in which the cooling roller of the upstream side comes into contact with the image surface, in a state where the continuous paper sheet has not been sufficiently cooled, the cooling roller comes into contact with the image surface, and thus image quality deterioration such as image missing is more likely to occur. However, in the third example, since the first cooling roller R11 of the upstream side comes into contact with the non-image surface, occurrence of image quality deterioration is suppressed.

Especially, in the cooling rollers R11 and R12 of the third example, the first cooling roller R11 of the upstream side has a larger outer diameter and has higher cooling capability. It is generally known that as temperature difference increases, heat conduction improves and cooling efficiency improves. Since the temperature of a part of the continuous paper sheet S closer to the fixing unit F is higher, if the cooling capability of the first cooling roller R11 of the upstream side is high, the cooling efficiency of the whole of the cooling mechanism improves. Therefore, as compared to the case where the cooling rollers R11 and R12 has the same cooling capability or the cooling capability of the cooling roller of the downstream side is higher, the cooling efficiency of the whole of the cooling mechanism improves.

Also, in the cooling rollers R11 and R12 of the third example, after the continuous paper sheet is cooled the first cooling roller R11 of the upstream side, the image surface is also cooled by the second cooling roller R12 of the downstream side. Therefore, as compared to the case where the image surface side is not cooled, the developers on the image surface are also likely to be sufficiently cooled. Therefore, while the continuous paper sheet is in contact with the conveying rollers R13 to R15 of the downstream side, image missing is unlikely to occur, and in a state where the continuous paper sheet has been wound around the take-up roller U3*c*, the developers are unlikely to stick to parts of the continuous paper sheet S overlapping the developers.

Further, in the cooling rollers R11 and R12 of the third example, the sliders 12 are supported so as to be movable along the guide rails 21. Therefore, if the cooling rollers R11 and R12 are moved along the guide rails 21, the winding angles of the continuous paper sheet S on the cooling rollers R11 and R12 change. If the contact areas of the cooling rollers R11 and R12 with the continuous paper sheet S increase, the cooling rollers are more likely to absorb heat, and thus the cooling capabilities improve. Therefore, in the third example, it is possible to adjust the cooling capabilities of the cooling rollers R11 and R12 by adjusting the winding angles.

First Modification of Third Example

Figure 10:
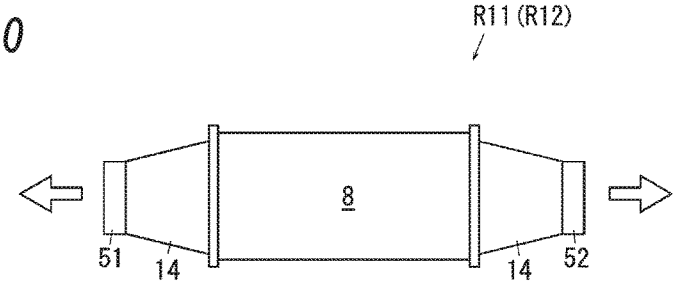
FIG. 10 is a view for explaining a first modification of the third example.

FIG. 10 is a view for explaining a first modification of the third example.

In the third example described above, the configuration having the front fan 17*a* and the rear fan 17*b* arranged to transfer gas from the outer side to the inner side in the axial direction has been described; however, the configuration of the fans are not limited thereto. As shown in FIG. 10, for example, the front fan 17*a* and the rear fan 17*b* may be installed reversely in the axial direction so as to transfer gas from the inner side to the outer side in the axial direction. In other words, in the third example, the fans 17*a* and 17*b* are configured to blow gas into the first cooling roller R11; however, they also can be configured to exhaust gas from the first cooling roller R11. In other words, it is also possible to install a front fan 51 and a rear fan 52 as an example of a first exhaust member and an example of a second exhaust member, respectively.

Second Modification of Third Example

Figure 11:
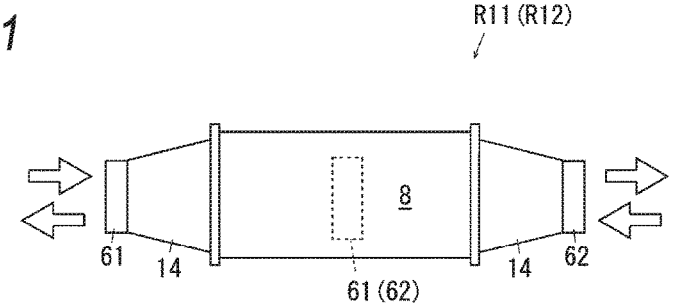
FIG. 11 is a view for explaining a second modification of the third example.

FIG. 11 is a view for explaining a second modification of the third example.

In the third example, the front fan 17*a* and the rear fan 17*b* are configured to rotate in a specific rotation direction during operation, thereby transferring gas in a specific direction; however, the configuration of the fans is not limited thereto. As shown in FIG. 11, for example, a fan 61 capable of normal rotation and reverse rotation may be used as an example of a transfer member such that it is possible to switch the direction of the flow of the gas by switching between normal rotation and reverse rotation at intervals of a predetermined time (one minute). However, in terms of the price of fans, the third example and the first modification of the third example can be realized at lower cost, and thus are more advantageous.

Also, in the second modification of the third example, if the fan 61 is rotated in a normal direction to suck gas and another fan 62 is rotated in a reverse direction to exhaust gas, it is possible to produce a flow of gas stronger than a flow of gas which is produced in the case where intake or exhaust is performed only on one side in the axial direction like the third example and the first modification of the third example. Therefore, it is possible to improve the cooling efficiency of the cooling rollers R11 and R12.

Also, in the case of using the fans 61 and 62 capable of normal rotation and reverse rotation, it is desirable to arrange them on both sides in the axial direction; however, it is also possible to install the fans only on one side, and is also possible to install the fans on both sides.

Further, the positions of the fans 61 and 62 are not limited to the end parts in the axial direction, and as shown by a broken line in FIG. 11, it is also possible to remove a part or the whole of the inner cylinder 4 of the cooling roller and install one fan inside the cooling roller in the axial direction. In the case where fans are installed inside each cooling roller, as compared to the case of installing the fans 61 and 62 at the end parts of each of the cooling rollers R11 and R12, it is possible to reduce the total lengths of the cooling rollers R11 and R12 in the axial directions.

Third Modification of Third Example

Figure 12:
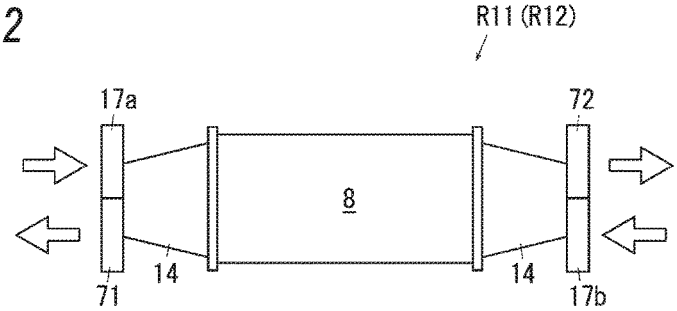
FIG. 12 is a view for explaining a third modification of the third example.

FIG. 12 is a view for explaining a third modification of the third example.

In the third example, as each of the front fan 17*a* and the rear fan 17*b*, one intake fan is arranged; however, they are not limited thereto. As shown in FIG. 12, for example, on the front side of each of the cooling rollers R11 and R12, an intake fan 17*a* which is an example of a first intake member and an exhaust fan 71 which is an example of a first exhaust member may be arranged, and on the rear side, an intake fan 17*b* which is an example of a second intake member and an exhaust fan 72 which is an example of a second exhaust member may be arranged, such that it is possible to produce an air flow by operating an intake fan on one side in the axial direction while operating an exhaust fan on the other side.

As shown in FIG. 12, the intake fans 17*a* and 17*b* and the exhaust fans 71 and 72 may be arranged such that in the radial direction, the intake fan 17*a* and the exhaust fan 71 neighbor each other and the intake fan 17*b* and the exhaust fan 72 neighbor each other; however, they may also be arranged such that in the axial direction, the intake fan 17*a* and the exhaust fan 71 neighbor each other and the intake fan 17*b* and the exhaust fan 72 neighbor each other.

Fourth Modification of Third Example

Figure 13:
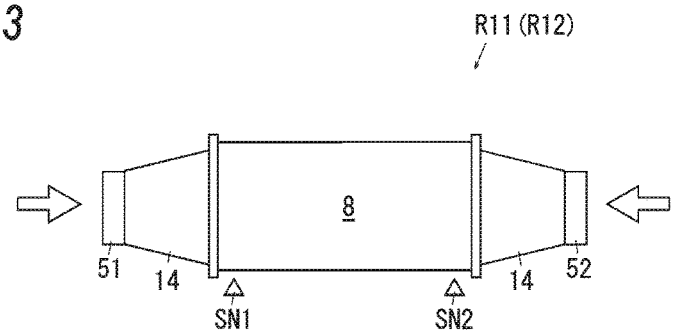
FIG. 13 is a view for explaining a fourth modification of the third example.

FIG. 13 is a view for explaining a fourth modification of the third example.

In the third example, timings to switch the direction of the flow of gas are set at intervals of one minute; however, the timings are not limited thereto. As shown in FIG. 13, for example, on both end parts of each of the cooling rollers R11 and R12 in the axial direction, temperature sensors SN1 and SN2 which are examples of temperature detection members may be installed to detect the temperature of the outer surface of the outer cylinder 8. In this configuration, in the case where a temperature detected by any one of the two temperature sensors SN1 and SN2 is equal to or higher than a predetermined upper limit of the temperature, the flow of gas may be switched. Alternatively, in the case where the temperature difference is equal to or higher than a predetermined temperature difference, the flow of gas may be switched.

Modifications

Although the examples of the present invention have been described above, the present invention is not limited to the above-described examples, and can be modified in various forms within the scope of the present invention disclosed in claims. Hereinafter, modification H01 to H16 of the present invention will be described.

(H01)

In the examples described above, the printer U has been described as an example of the image forming apparatus. However, the image forming apparatus is not limited thereto, and may be configured with any other apparatus such as a copy machine, a FAX, or a multi-function apparatus having two or more of a printing function, a copy function, and a facsimile function.

(H02)

In the examples described above, as the printer U, the configuration in which the developers of five colors are used has been described. However, the present invention is not limited thereto, and can also be applied to image forming apparatuses using one color and image forming apparatuses using two or three colors, or six or more colors.

(H03)

In the examples described above, the case of adjusting (i) the magnitudes of outer diameters, (ii) whether to form a release layer, (iii) the volumes of gas from the external coolers 26 and 26', and (iv) the winding angles (contact areas) θ1 and θ2 in order to make the cooling capability of the first cooling roller R11 of the upstream side higher than the cooling capability of the second cooling roller R12 of the downstream side has been described. However, the present invention is not limited thereto. It is also possible to adjust any one of (i) to (iv), and it is also possible to adjust two or three of them. For example, in the case of adjusting the cooling capabilities by only (i), it is possible to provide release layers on both of the cooling rollers, or to set the volumes of gas from the external coolers 26 and 26' to the same volume, or to set the winding angles θ1 and θ2 to the same angle.

Besides (i) to (iv), it is also possible to add other adjustment methods. For example, a method of setting the volumes of gas from the fans 17*a* and 17*b* of the first cooling roller R11 larger than those from the fans 17*a*' and 17*b*' of the second cooling roller R12 can be used to adjust the cooling capabilities.

Also, the amounts of heat which the cooling rollers dissipate the continuous paper sheet S mainly depend on the magnitudes of contact areas, temperature differences, and heat conductivities. Contact areas can be adjusted by adjusting the outer diameters of the cooling rollers R11 and R12 and the winding angles θ1 and θ2. Also, temperature differences can be adjusted by controlling the temperatures of the cooling rollers R11 and R12 by adjusting the volumes of gas from the fans 28 and 28'. Heat conductivities depend on the surface layers of the cooling rollers R11 and R12 and the material of the continuous paper sheet S. Since contact areas, temperature differences, and heat conductivities have different effects on the amounts of heat dissipation, according to the configuration and fixing temperature of the printer U, the distance from the fixing unit F, the materials of continuous paper sheets S, and so on, it may be most effective to adjust contact areas, or it may be most effective to adjust temperature differences. Therefore, in the case where it is impossible to use all of the adjustment methods, it is desirable to select effective cooling-capability adjustment methods according to the configuration and the like of the printer U.

(H04)

In the examples described above, the configuration in which the fans 17 and 17' are arranged at the end parts in the axial directions has been described; however, they can also be arranged at the center parts in the axial directions. Also, although the fans 17 and 17' are arranged so as to function as intake fans for blowing the gas into the cooling rollers R11 and R12; however, they can be arranged so as to exhaust the gas. It also is possible to use fans capable of normal rotation and reverse rotation.

(H05)

In the examples described above, it is desirable to use the configuration having the inner cylinder 4; however, it is also possible to use a configuration without the inner cylinder 4.

(H06)

In the examples described above, it is desirable to provide the external coolers 26 and 26'; however, in the modification H03, in the case where the external coolers 26 and 26' are not needed to adjust the cooling capabilities, it is possible to use a configuration having no external coolers.

(H07)

In the examples described above, it is desirable to provide components capable of adjusting the winding angles, like the sliders 12 and the guide rails 21; however, the present invention is not limited thereto. In the modification H03, in the case where the winding angles are not used to adjust the cooling capabilities, components for adjusting the winding angles may not be provided. Also, instead of using the sliders 12 and the guide rails 21, it is possible to use a method of changing the posture and path of a continuous paper sheet S by pushing the continuous paper sheet toward the upstream side or the downstream side can be used to adjust the winding angles.

(H08)

In the examples described above, the configuration in which the outer cylinder 8 is rotated with conveyance of the continuous paper sheet S has been described; however, the present invention is not limited thereto. The outer cylinder 8 can also be driven by a motor and gears.

(H09)

In the examples described above, the configuration in which the front fan 17*a* and the rear fan 17*b* are operated and stopped in turn has been described; however, the present invention is not limited thereto. In view of a time required until rotation of the fans 17*a* and 17*b* becomes stable, a time required until the flow of gas sent already reaches to the end of the other side, and so on, during switching of the fans 17*a* and 17*b*, it is possible to set a period when both of them do not operate, or conversely, to set a period when both of them operate.

(H10)

In the examples described above, the present invention can be properly used in image forming apparatuses using continuous paper sheets S; however, the present invention can also be applied to image forming apparatuses using cut paper sheets.

(H11)

In the examples described above, the configuration in which the second cooling roller R12 has the release layer and the first cooling roller R11 has no release layer and thus the amounts of heat absorption are different has been described; however, the present invention is not limited thereto. The outer cylinder 8' of the second cooling roller R12 may be made of a material having heat conductivity lower than that of the material of the outer cylinder 8 of the first cooling roller R11, such that the amount of heat absorption of the second cooling roller becomes smaller. Also, in the case where it is not required to change the materials in order to change the amounts of heat absorption, release layers may be formed on both of the first and second cooling rollers, or may not be formed on both of the first and second cooling rollers.

(H12)

In the examples described above, the configuration in which the cooling rollers R11 and R12 are rotated with conveyance of the continuous paper sheet S has been described; however, the present invention is not limited thereto. One or both of the outer cylinders 8 and 8' of the cooling rollers R11 and R12 may be driven by drive sources such as motors.

(H13)

In the examples described above, the configuration having the two cooling rollers R11 and R12 which are examples of transfer members has been described; however, the present invention is not limited thereto. According to necessary cooling performance, one, or three or more cooling rollers may be provided.

(H14)

In the examples described above, the configuration in which the projections 4*a* are formed by making cuts in the inner cylinders 4 and 4' and bending the cut parts outward has been described; however, the present invention is not limited thereto. For example, it is possible to provide projections or protrusions on the inner surfaces of the inner cylinders 4 and 4' by bonding or the like. Also, in the case of making the inner cylinders 4 and 4' of a resin, it is also possible to form projections or protrusions integrally. The configuration in which the inner cylinders 4 and 4' have the projections is desirable since processing is easy; however, on the inner peripheries of the outer cylinders 8 and 8', projections may be formed so as to be able to stir the flow of air in the passage 16.

(H15)

In the examples described above, it is desirable to suppress gas from flowing into the inner cylinders 4 and 4' by the hub units 3 and the caps 13; however, gas may be transferred into the inner cylinders 4 and 4'.

(H16)

In the examples described above, it is desirable to arrange the projections 4*a* along spirals; however, they may be arranged in ring shapes, or may be arranged along the axial directions.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium cooling apparatus comprising:

a first cooling unit that cools a medium by absorbing heat from the medium when the medium is in contact with an outer surface of the first cooling unit;

a second cooling unit that is arranged on the downstream side from the first cooling unit in a medium conveyance direction, and cools the medium by absorbing heat from the medium when the medium is in contact with an outer surface of the second cooling unit, and is set such that an amount of heat absorption is smaller than an amount of heat absorption of the first cooling unit; and an adjustment mechanism that adjusts the amounts of heat absorption of the first and second cooling units.

2. The medium cooling apparatus according to claim 1, wherein:

the outer surface of the first cooling unit comes into contact with an opposite surface of the medium with respect to an image recording surface, and the second cooling unit comes into contact with the image recording surface of the medium.

3. The medium cooling apparatus according to claim 2, wherein:

the second cooling unit has a release layer as the outer surface.

4. The medium cooling apparatus according to claim 1, wherein:

the adjustment mechanism adjusts the amounts of heat absorption by adjusting an amount of contact of the medium with at least one of the first cooling unit and the second cooling unit.

5. The medium cooling apparatus according to claim 1, further comprising:

a first transfer member that transfers gas to cool the first cooling unit;

a second transfer member that transfers gas to cool the second cooling unit; and a controller that adjusts the amounts of heat absorption by adjusting a volumes of gas from the first and second transfer members.

6. The medium cooling apparatus according to claim 1, wherein:

the first cooling unit has a cylindrical shape, and the second cooling unit has a cylindrical shape having a diameter smaller than a diameter of a cylindrical shape of the first cooling unit.

7. A medium cooling apparatus comprising:

a cooling member that cools a medium by absorbing heat from the medium, and is rotated with conveyance of the medium, and has an internal space extending along a direction of the rotation axis;

a transfer member that transfers gas along the internal space extending in an axial direction; and a stirring member that is arranged in the internal space of the cooling member and stirs gas flowing in the internal space of the cooling member, wherein the stirring member has projections formed on an outer surface of a cylindrical shape of the stirring member.

8. The medium cooling apparatus according to claim 7, wherein:

the projections are formed in plate shapes inclined with respect to the axial direction.

9. The medium cooling apparatus according to claim 7, wherein:

the projections are formed by making cuts in an outer periphery of the stirring member and bending a cut parts.

10. The medium cooling apparatus according to claim 7, wherein:

the stirring member rotates at a speed different from the speed of rotation of the cooling member.

11. The medium cooling apparatus according to claim 10, wherein:

the stirring member rotates in the same direction as the rotation direction of the cooling member.

12. The medium cooling apparatus according to claim 10, wherein:

the stirring member rotates in the opposite direction to the rotation direction of the cooling member.

13. A medium cooling member comprising:

a rotary unit that rotates in a state where an outer surface is in contact with a medium;

a gas passage that extends along an inner surface of the rotary unit and along a rotation axial direction of the rotary unit and that gas flows through;

a transfer member that transfers gas into the gas passage; and a controller that performs switching between transfer of gas from one side in an axial direction and transfer of gas from the other side in the axial direction, with respect to the gas passage.

14. The medium cooling member according to claim 13, wherein:

the transfer member includes a first transfer member arranged at one end part in the axial direction, and a second transfer member arranged at the other end part in the axial direction.

15. The medium cooling member according to claim 14, wherein:

the first transfer member is arranged at the one end part in the axial direction and transfers gas from one side toward the other side in the axial direction, the second transfer member is arranged at the other end part in the axial direction and transfers gas from the other side toward the one side in the axial direction, and the controller operates the first transfer member and the second transfer member in turn, and stops the operations of the first transfer member and the second transfer member in turn such that when one of the first and second transfer members operates, the other does not operate.

16. The medium cooling member according to claim 14, wherein:

the first transfer member includes a first intake member that is arranged at the one end part in the axial direction and transfers gas from the one side toward the other side in the axial direction of the rotary member, and a first exhaust member that is arranged at the one end part in the axial direction and transfers gas from the other side toward the one side in the axial direction of the rotary member, the second transfer member includes a second intake member that is arranged at the other end part in the axial direction and transfers gas from the other side toward the one side in the axial direction of the rotary member, and a second exhaust member that is arranged at the other end part in the axial direction and transfers gas from the one side toward the other side in the axial direction of the rotary member, and the controller switches between a state where the first intake member and the second exhaust member are controlled to operate and the second intake member and the first exhaust member are controlled not to operate and a state where the second intake member and the first exhaust member are controlled to operate and the first intake member and the second exhaust member are controlled not to operate.

17. The medium cooling member according to claim 13, wherein:

the controller performs switching when a preset time elapses.

18. The medium cooling member according to claim 13, further comprising:

a detection member that detects a temperature of the rotary unit, wherein in the case where the temperature detected by the detection member is equal to or higher than a preset temperature, the controller switches the gas transfer direction.

* * * * *